US006544062B1

(12) United States Patent
Loveless et al.

(10) Patent No.: US 6,544,062 B1
(45) Date of Patent: Apr. 8, 2003

(54) CONNECTOR ARRAY WITH CONNECTORS HAVING OUTER SURFACES IN GEAR-TO-GEAR CONTACT

(75) Inventors: Richard Whitcomb Loveless, Burlington, VT (US); Thomas Peter Dix, Winooski, VT (US)

(73) Assignee: Huber & Suhner, Inc., Essex Jct., VT (US)

( * ) Notice: Subject to any disclaimer, the term of this patent is extended or adjusted under 35 U.S.C. 154(b) by 0 days.

(21) Appl. No.: 10/078,230

(22) Filed: Feb. 19, 2002

(51) Int. Cl.[7] ..... H01R 13/62
(52) U.S. Cl. ..... 439/310; 439/362
(58) Field of Search ..... 439/310, 311, 439/320, 339, 578, 581, 362, 363, 364, 365; 285/124.2; 81/57, 57.14, 57.3, 57.22

(56) References Cited

U.S. PATENT DOCUMENTS

| | | | | | |
|---|---|---|---|---|---|
| 2,069,882 | A | * | 2/1937 | Hall | 81/467 |
| 3,590,377 | A | | 6/1971 | Sorger | 324/158 |
| 3,905,254 | A | * | 9/1975 | Palatnick et al. | 81/57.3 |
| 4,515,043 | A | * | 5/1985 | Gray | 81/57.22 |
| 4,997,305 | A | * | 3/1991 | Yang | 403/322 |
| 5,074,170 | A | * | 12/1991 | Shirley | 81/57.3 |
| 5,098,312 | A | * | 3/1992 | Raczynski | 439/362 |
| 5,169,334 | A | * | 12/1992 | Makita | 439/362 |
| 5,218,758 | A | * | 6/1993 | Nguyen | 29/837 |
| 5,456,611 | A | | 10/1995 | Henry et al. | 439/180 |
| 5,461,325 | A | | 10/1995 | Duggan | 324/754 |
| 5,651,698 | A | | 7/1997 | Locati et al. | 439/578 |
| 5,752,847 | A | | 5/1998 | McCormick | 439/349 |
| 6,134,989 | A | * | 10/2000 | Stevens | 81/57.22 |
| 6,305,245 | B1 | * | 10/2001 | Kress | 81/57.22 |
| 6,305,965 | B1 | * | 10/2001 | D'Inca | 439/362 |
| 6,406,315 | B1 | * | 6/2002 | Bates, III et al. | 439/310 |

* cited by examiner

*Primary Examiner*—P. Austin Bradley
*Assistant Examiner*—Ross Gushi
(74) *Attorney, Agent, or Firm*—Burr & Brown

(57) ABSTRACT

An array of coaxial cable connectors includes a generally cylindrical-shaped first female member with an inner surface having at least one set of left-hand threads adapted to engage complementary threads on a first male port. A generally cylindrical-shaped second female member has an inner surface including at least one set of right-hand threads adapted to engage complementary threads on a second male port. A mounting member allows for rotation of each of the first and second female members about their respective longitudinal axes while maintaining a portion of the outer surface of the first female member (preferably configured as a gear) in contact with a portion of the outer surface of the second female member (preferably configured as a complementary gear). In operation, rotation of the first female member about its longitudinal axis results in a corresponding rotation of the second female member about its longitudinal axis.

40 Claims, 8 Drawing Sheets

CONNECTOR ARRAY WITH CONNECTORS HAVING OUTER SURFACES IN GEAR-TO-GEAR CONTACT

FIELD OF THE INVENTION

This invention relates generally to coupling of connector arrays, and more particularly to the coupling of coaxial cable connector arrays in which adjacent female members have outer surfaces in gear-to-gear contact with one another, and include inner surfaces having left-and right-hand threads engaging corresponding threads on male ports, such that rotation of one female member causes simultaneous rotation of the adjacent female member.

BACKGROUND OF THE INVENTION

Independent coaxial lines provide closed, controlled-impedance pathways for the transmission of electrical and RF energy. High electrical performance at high frequencies is possible using coaxial cable and connectors, as well as protection for signals that are sensitive to electrical interference. Coaxial cable and connectors are used in many applications requiring the transfer of signals between devices such as in radio base stations, test and measurement equipment, avionics, cable antenna television (CATV) systems and communication networks.

Conventional coaxial connectors function to supply the necessary electrical and mechanical connection between a terminated end of the coaxial cable and a port or terminal segment of a particular device, such as antenna and receiver sets in a CATV system or testing probes used in testing equipment. Coaxial connectors have three distinct groups of component features that solve three distinct functional problems. These include mating features for signal transmission, mechanical coupling features to attain and secure the mated position, and any additional features included for mechanically mounting the connector within a system. Connector coupling is typically accomplished by a bayonet, snap-on, or threaded mechanism. Bayonet and snap-on coupling mechanisms provide quick connect/disconnect functionality while threaded connections provide more mechanically and electrically robust coupling and connection. Connectors with threaded couplings tend to function better at higher frequencies with better shield continuity and with much greater resistance to the negative effects of bending forces and vibration. Actuation of coupling mechanisms is accomplished through manual rotation of bayonet style couplings, manual insertion of snap-on couplings, or manual operation of a torque wrench for threaded couplings; all without the advantage of power tools.

FIG. 10 shows the basic components of a prior art connector array. The prepared end of a coaxial cable 1 is terminated in one end of a connector 2. The coaxial cable 1 and the connector body 2 utilize a coupling nut 4, which serves as means to secure the other end of the connector onto a threaded port 5 positioned on a substrate 6. In use, signals propagate from the terminated end of each of the coaxial cables to the device threadedly linked to the connectors.

As illustrated above, this prior art coaxial cable connector array employs coupling nuts to supply a suitable mechanical connection between the threaded surfaces of the connectors and the ports. However, independent rotation of each individual coupling nut is tedious and time-consuming, especially when it is desirable to repeatedly engage and disengage the connectors over a relatively short period of time, such as is the case in many testing probe applications.

Moreover, in addition to not being suitable for convenient and repeated engagement cycles, prior art threaded coaxial cable connector arrays have the additional inconvenience of requiring a minimum spacing between the outer circumferences of each rotatable coupling nut to allow tool access for the rotation of the coupling nuts upon mating with the ports. Bayonet and snap-on connectors that have been arranged in an array also require a minimum spacing between the outer circumference of adjacent connectors to allow access for fingers or for a tool to be used for mating and de-mating.

In some cases, increased density of RF connections can be accomplished with snap-on connectors that have been grouped together onto a common mounting bracket. However, this has practical limitations to a small group size because of the combined insertion forces that must be overcome, typically without the mechanical advantage of a tool. Consequently, the number of connectors that may be positioned in a particular area of a substrate or device is practically limited in prior art coaxial cable connector arrays for RF applications.

It would be desirable to provide an array of coaxial cable connectors that can be more readily and instantaneously secured to corresponding ports while maintaining sufficiently high integrity and propagation of signals (particularly RF signals) from the coaxial cables through the connectors. It would be desirable to provide a more compact coaxial cable connector array that allows for the connectors to be more highly concentrated in a particular area of a device, and thus, provide the added benefit of saving space. It would also be desirable to provide a coaxial cable connector array where coupling can be actuated with the mechanical advantage of a power tool to overcome the total coupling forces within a multi-RF connector, to provide reach into somewhat confined spaces, and to ensure that adequate coupling forces can be applied.

SUMMARY OF THE INVENTION

It is an object of the present invention to overcome the drawbacks of the prior art. In particular, a coaxial cable connector array is provided, wherein adjacent female members employing left-hand and right-hand threaded engagement surfaces are more readily and instantaneously mated to corresponding threads of male ports through the use of gear-to-gear intermeshing between the outer surfaces of the adjacent female members. Since the outer surfaces of adjacent female members are in intermeshing contact with one another, the coaxial cable connector array of the present invention allows the connectors to be more highly concentrated in a particular area of a device, and thus, provides compactness to achieve the added benefit of saving space. The gear-to-gear connection between female members also allows for the transmission of rotational power for mating and de-mating every connector in the array. Including an actuator (e.g., an electrically non-functional female member having a hex-head receiving hole) in the array allows the use of a power tool (e.g., cordless screwdriver) to accomplish coupling in a single operation. Preferably, the female members would mate during forward rotation of the power tool, and de-mate during reverse rotation of the power tool.

In accordance with one embodiment of the present invention, an array of coaxial cable connectors includes first and second female members and a mounting member. The first female member has a generally cylindrical shape about a longitudinal axis thereof and inner and outer surfaces. The inner surface includes at least one set of left-hand threads adapted to engage complementary threads on a first male port. The outer surface includes a gear configuration having gear teeth extending axially along the outer surface in substantial parallel alignment with the longitudinal axis of the first female member. A first end of the first female member is located at a position near the left-hand threads and a second end is located at a position opposite that of the first end.

The second female member has a generally cylindrical shape about a longitudinal axis thereof and inner and outer surfaces. The inner surface includes at least one set of right-hand threads adapted to engage complementary threads on a second male port. The outer surface includes a gear configuration having gear teeth extending axially along the outer surface in substantial parallel alignment with the longitudinal axis of the second female member. A first end of the second female member is located at a position near the right-hand threads and a second end is located at a position opposite that of the first end.

The mounting member can be attached to the first or second ends of each of the first and second female members. The mounting member allows for rotation of each of the first and second female members about their respective longitudinal axes, and maintains a portion of the outer surface of the first female member in contact with a portion of the outer surface of the second female member.

It is preferred that the first and second female members are secured to the mounting member such that the starting positions of the threads are in alignment at the same clock position to reduce variations in coupling from member to member. This enables the two female members to engage their respective threaded male ports at the same time and position, which in turn allows the female members to have minimal variations in coupling pressures exerted at the RF interface within large arrays. However, this positioning of thread starts is not a requirement to achieve coupling; a certain amount of independent axial floating can be designed into each female member, as discussed in detail below, to compensate for non-synchronous thread starts from member to member.

In operation, the gear teeth of the first female member intermesh with the gear teeth of the second female member, such that rotation of the first female member about its longitudinal axis causes a corresponding rotation of the second female member about its longitudinal axis. In this manner, the first and second female members are concurrently screwed down onto corresponding male ports. Consequently, the coaxial cable connector array of the present invention yields a more efficient mating process over the prior art requirement of tediously mating the threads of each connector member with the threads of each port one at a time.

In addition, since the first and second female members are in intermeshing contact with one another, the coaxial cable connector array of the present invention overcomes the need for a minimum amount of spacing between the outer circumferences of the first and second female members making up the array.

In a preferred embodiment of the present invention, the mounting plate contains a plurality of holes passing therethrough in a predetermined array. A cable-terminated connector body is inserted from a second side of the mounting plate through one of the holes and is received, on the first side of the mounting plate, in a female member through a snap-ring arrangement, for example. A stop member is provided on the second end of the connector body to maintain its axial position on the second side of the mounting plate.

It is also preferred that the connection between the connector body and the female member allow independent axial displacement of each female member relative to the connector body. Since the female member carries the threaded portion, this independent axial displacement will insure that each female member can fully engage its male port counterpart without restriction imposed by another member of the array that may be fully engaged.

The array can also include a positioning member located at the end of each of the first and second female members opposite to the end where the mounting plate is located. If desired, the positioning members can serve as an alternative to the mounting member as well. In this regard, the positioning member located on the first female member is preferably configured to include at least one locking member complementary in shape to at least one locking member on a positioning member located on the second female member, such that the locking member of the first female member interlocks with the locking member of the second female member. In this manner, the positioning members can collectively define the mounting member when interlocked with one another.

The positioning members, in addition to or independent of the mounting member, serve to maintain the longitudinal axis of the first female member substantially parallel to the longitudinal axis of the second female member. In addition to maintaining the alignment of the female members, the positioning members are also configured to prevent any two of the first female members, which include left-hand threads, from being positioned adjacent to one another and to prevent any two of the second female members, which include right-hand threads, from being positioned adjacent to one another. This alternating left-hand/right hand arrangement is necessary when adjacent female members contact one another, since the female members would rotate in opposite directions.

The alternating left-hand/right hand function of the positioning members may also be built into the existing parts of the connectors. For example, the left-hand threaded and right-hand threaded female members could be made of different colored materials to provide visual differentiations. Alternatively, the left-hand threaded connectors could include a uniquely shaped connector body that would allow insertion into only alternating holes provided in the mounting plate.

Moreover, the layout of mounting positions for individual connectors within mounting members is only restricted by maintaining accurate center locations where gear-to-gear meshing is to occur. Any number of mounting position patterns can be designed into the mounting members providing the advantage of flexibility over prior art connector arrays which include fixed connector components. For instance, in using the coaxial cable connector array of the present invention, the user can tailor the connector array to meet the demands of a variety of specialized applications instead of adjusting a particular application to the limitations of the prior art. That is, the modularity of the present connector easily allows custom designs of unique large scale arrays.

In accordance with another embodiment of the present invention, the array includes a separate rotation mechanism having an outer surface that is substantially the same as the outer surfaces of each of the first and second female members. The inner surface is configured for receiving a tool for rotation, such as a hex wrench driven by a power tool (e.g., a cordless screwdriver). Upon rotation of the separate rotation mechanism about its longitudinal axis, the first and second female members are rotated simultaneously about their longitudinal axes.

Alternatively, a "dummy" female member could be mounted on the power tool itself and inserted into the array to rotate all the female members of the array. The array preferably would include a spare hole in the mounting plate in which the "dummy" female member would temporarily reside during the coupling operation.

In accordance with yet another embodiment of the present invention, a rotatable ring member having a generally annular shape about a longitudinal axis thereof is positioned on the outer surface of the mounting member discussed above. A plurality of first female members are planetarily arranged about an inner surface of the ring member. The ring member has a gear configuration complementary to the gear configuration on each of the plurality of first female members, such that rotation of the ring member causes simultaneous rotation of the plurality of first female members about their longitudinal axes. Second female members could also be used in intermeshing contact with the first female members.

In accordance with another embodiment of the present invention, a female member/male port combination is provided, wherein the above-discussed first and second female members are simultaneously mated with first and second male ports, respectively. The first male port has a generally cylindrical shape about a longitudinal axis thereof and an outer surface that includes threads which are complementary to threads of the first female member (i.e., left-hand threads). The second male port has a generally cylindrical shape about a longitudinal axis thereof and an outer surface that includes threads which are complementary to threads of the second female member (i.e., right-hand threads).

The first and second male ports are arranged alternately to correspond to the alternating arrangement of the first and second female members. The starting positions of the threads on the male ports are also preferably arranged at the same clock position. This will insure that the female members engage their respective male ports at the same time. If the threads on the male and female parts are not clocked in this manner, the "over travel" designed into each female member (discussed below) would compensate for this arrangement.

The positioning member discussed above can also be provided on the first and second male ports. As is the case when the positioning members are located on the female members, when a positioning member is located on each of the first and second male ports, it is configured to prevent any two of the first male ports and any two of the second male ports from being positioned adjacent to one another. Again, this alternating arrangement is necessary when adjacent, contacting female members are used, since the female members would rotate in opposite directions.

All of the embodiments of the present invention described above provide a more compact coaxial cable connector array delivering increased efficiency in the use of time and labor through the employment of adjacent first and second female members in gear-to-gear intermeshing contact with one another, such that rotation of one component of the array, such as a first female member, a separate rotation mechanism or a ring member, allows for the simultaneous mating to male ports of all of the first and second female members making up the array.

The present invention also finds application in areas outside the coaxial cable field. That is, the present invention could be used anytime it is desired to simultaneously activate an array of threaded connectors or like members (e.g., an array of tubing connections for movement of fluids or gases, fiber optic transmission lines, RF waveguides).

BRIEF DESCRIPTION OF THE DRAWINGS

For a more complete understanding of the nature and objects of the invention, references should be made to the following detailed description read in connection with the accompanying drawings, in which.

DETAILED DESCRIPTION OF THE INVENTION

Figure 1:
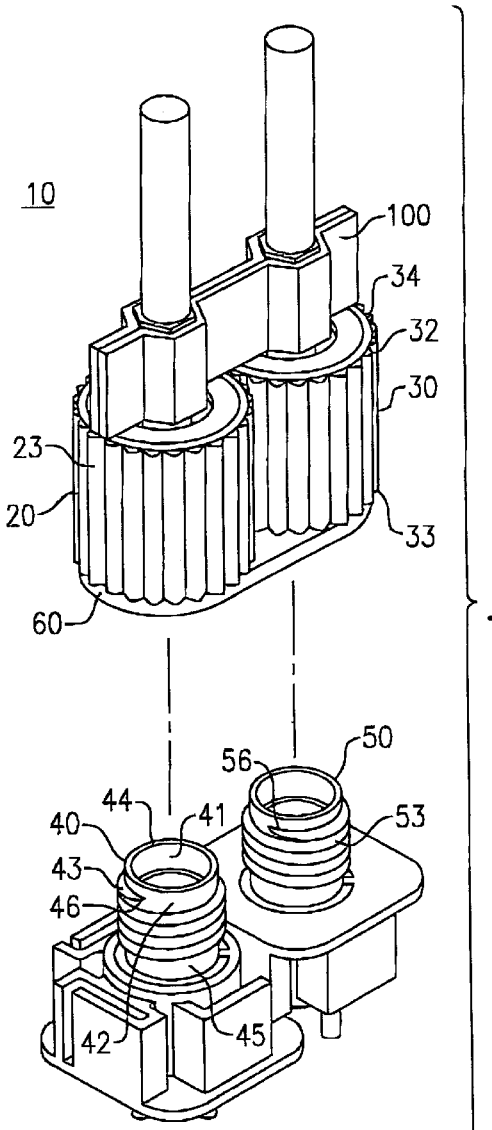
FIG. 1 is a perspective view of one embodiment of the first and second female members and the first and second male ports in accordance with the present invention.
Figure 2:
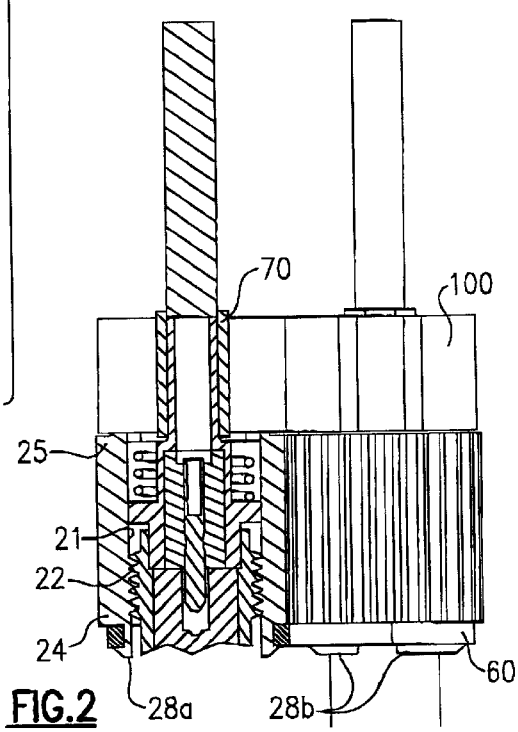
FIG. 2 is cross-sectional view of the second male port/female member and a side view of the first male port/female member of FIG. 1.

FIGS. 1 and 2 illustrate a first embodiment of the present invention. An array of cable connectors 10 includes a first female member 20, a second female member 30, a mounting member 60 and a positioning member 100.

The first female member 20 has a generally cylindrical shape about a longitudinal axis thereof. An inner surface 21 (FIG. 2) of first female member 20 has at least one set of threads 22 adapted to engage complementary threads on a first male port 40 (the male port will be discussed in more detail later herein). Threads 22 of first female member 20 are right-hand threads. An outer surface 23 of first female member 20 has sufficient surface roughness to cause rotation of second female member 30 upon rotation of first female member 20. In particular, outer surface 23 includes a gear configuration having gear teeth extending axially along outer surface 23 in substantial parallel alignment with the longitudinal axis of first female member 20. A first end 24 of first female member 20 is positioned near threads 22 and a second end 25 is located opposite first end 24.

The second female member 30 has a generally cylindrical shape about a longitudinal axis thereof and includes the same components as first female member 20, except the threads, which are adapted to engage complementary threads on a second male port 50, are left-hand threads with a starting position located at the same initial clock position as the threads of first female member 20. An outer surface 32 of second female member 30 has sufficient surface roughness to allow for rotation of second female member 30 upon rotation of first female member 20. In particular, outer surface 32 includes a gear configuration having gear teeth extending axially along outer surface 32 in substantial parallel alignment with the longitudinal axis of second female member 30. A first end 33 of second female member 30 is positioned near threads 22 and a second end 34 is located opposite first end 33.

The first male port 40 has a generally cylindrical shape about a longitudinal axis thereof, an inner surface 41, an opposed outer surface 42, a first end 44 and an opposed second end 45. The outer surface 42 includes threads 43 complementary to threads 22 (i.e., right-hand threads) of first female member 20. The threads 43 have a starting position 46. The second male port 50 includes the same components as first male port 40, except the threads 53 are complementary to the threads (i.e., left-hand threads) of second female member 30. The threads on the outer surface of second male port 50 have a starting position 56 that is arranged at the same clock position as starting position 46 of threads 43.

The mounting member 60 is attached to each of first female member 20 and second female member 30 via retaining mechanism 28*a* which extends from each of first ends 24 and 33 of first and second female members 20 and 30, respectively. In this regard, retaining mechanism 28*a* has a plurality of resilient fingers 28*b* spaced apart from one another radially about first ends 24 and 33. Fingers 28*b* engage respective portions of mounting member 60 to hold each of first female member 20 and second female member 30 on mounting member 60. In operation, mounting member 60 serves to allow for rotation of each of first female member 20 and second female member 30 about their respective longitudinal axes while maintaining a portion of the gear configuration on first female member 20 in intermeshing contact with a portion of the gear configuration on second female member 30. Rotation of first female member 20 about its longitudinal axis causes simultaneous rotation of second female member 30 about its longitudinal axis.

Figure 3A:
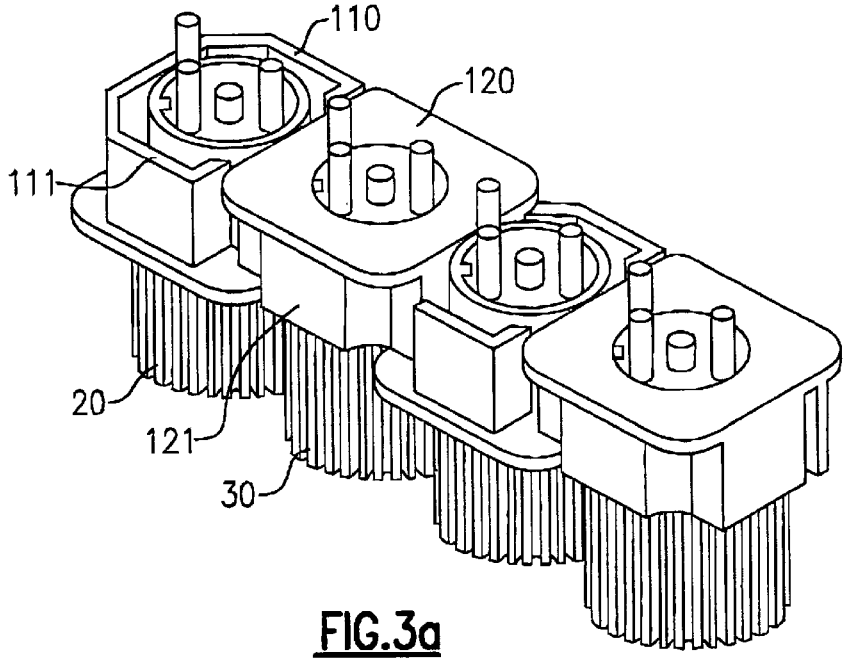
FIGS. 3*a* and 3*b* are perspective views illustrating the positioning members on the female members.
Figure 3B:
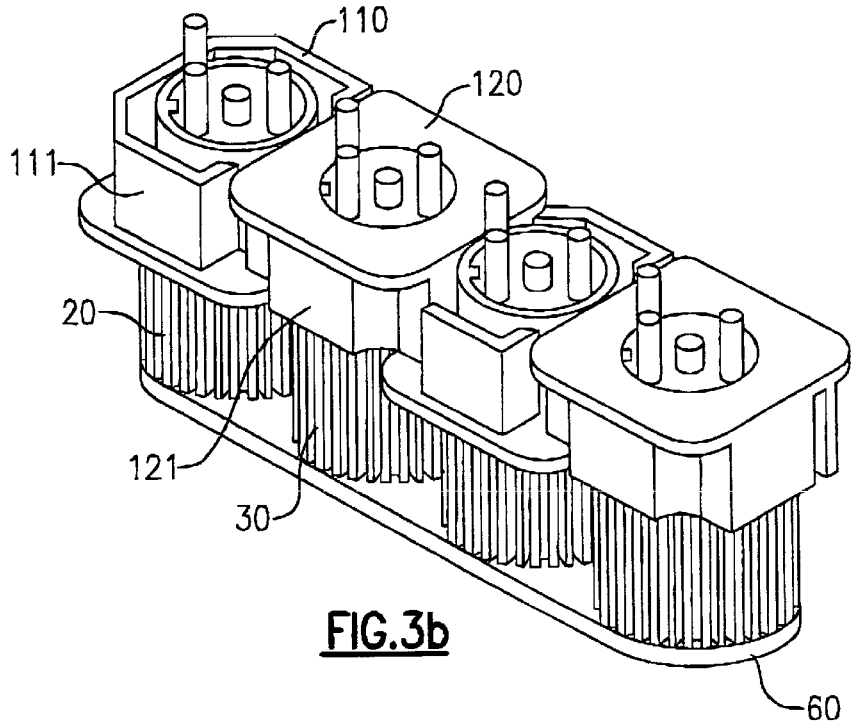
Figure 3C:
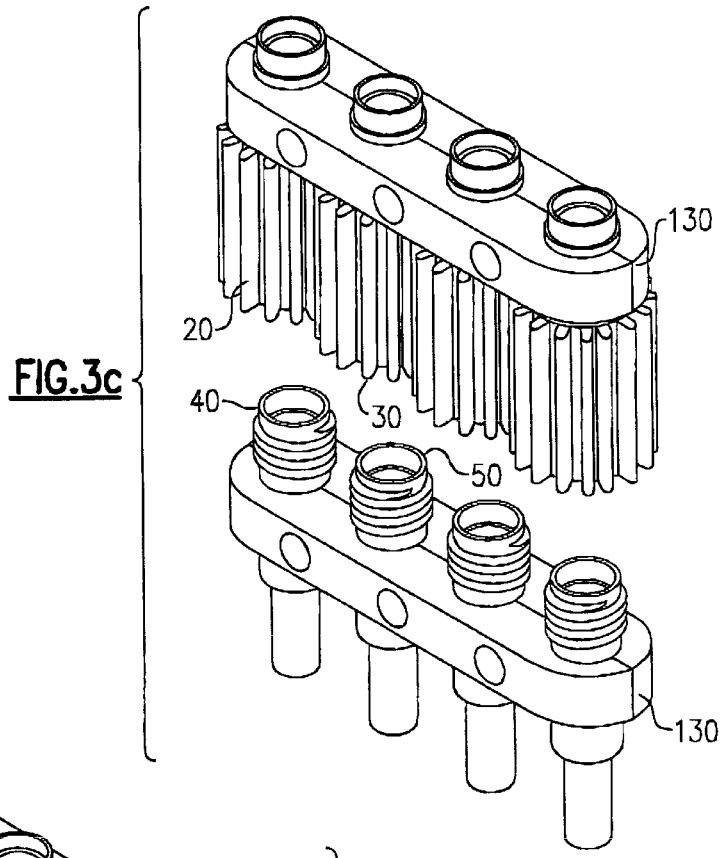
FIGS. 3*c* and 3*d* show that the positioning members can be located on both the female members and the male ports in the female member/male port combination in accordance with the present invention.
Figure 3D:
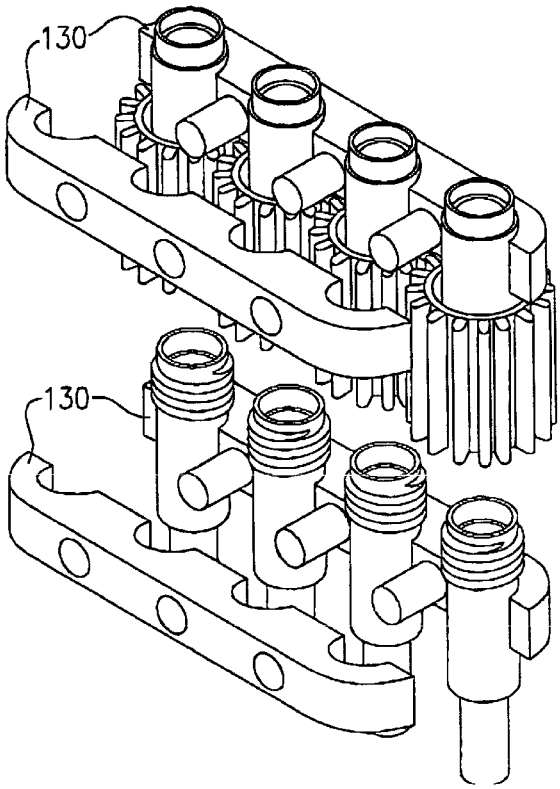

The positioning member 100 can be included to surround an outer conductor 70 located on second ends 23 and 34 of first and second female members 20 and 30, respectively. As an alternative to positioning member 100, positioning member 110 (shown in FIGS. 3*a* and 3*b*) can be located on second end 25 of first female member 20 and positioning member 120 can be located on second end 34 of second female member 30. In this regard, positioning member 110 includes at least one locking member 111 (shown more clearly in FIG. 6*b* as used on male port 40) that is complementary in shape to at least one locking member 121 (shown more clearly in FIG. 6*a* on male port 50) of positioning member 120, such that locking member 111 interlocks with locking member 121. Another alternative is positioning member 130 (shown in FIGS. 3*c* and 3*d*) positioned on second ends 25 and 34 of first and second female members 20 and 30, respectively. Positioning member 130 is split into halves, with posts 131 used to join the halves to one another. Positioning member 130 can also be located on the male ports, as shown in FIGS. 3*c* and 3*d*.

In use, positioning members 100, 110, 120 and 130 operate to maintain the longitudinal axis of first female member 20 substantially parallel to the longitudinal axis of second female member 30. As a result, the positioning members supply the appropriate center-to-center distance between each of the female members for gear meshing and the correct alignment for thread starts. In addition to maintaining the alignment of the female members, locking members 111 and 121 are configured to prevent any two first female members 20, which have right-hand threads, from being positioned adjacent to one another and to prevent any two second female members 30, which have left-hand threads, from being positioned adjacent to one another. Furthermore, positioning members 110, 120 and 130 can be used with mounting member 60 (FIG. 3*b*) or can also serve as substitutes for mounting member 60 (FIGS. 3*a*, 3*c* and 3*d*), which is ordinarily positioned near first end 24 of first female member 20 and first end 33 of second female member 30. In this regard, locking members 111 and 121 of positioning members 110 and 120, respectively, collectively define a mounting member when interlocked with one another. Similarly, when the halves of positioning member 130 are interlocked (shown in FIG. 3*c*), mounting member 60 can be omitted as well.

To secure the female members to the male ports, one of the female members would be rotated to align and engage the starting positions of threads 22 with the starting positions 46 and 56 of threads 43 and 53, respectively. Continued rotation of one of the female members will cause the mating threads to fully engage one another. It can be appreciated from FIG. 1 that the female members will rotate in opposite directions, thus the need for alternating left-hand and right-hand thread sets.

Figure 4A:
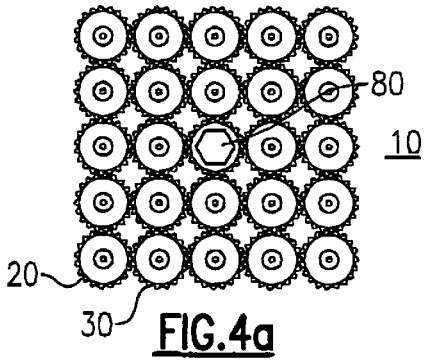
FIGS. 4*a* and 4*b* are top views showing alternative arrangements of the first and second female members and a separate rotation mechanism of another embodiment of the present invention.
Figure 4B:
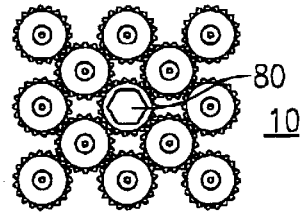

FIGS. 4*a* and 4*b* show another embodiment of the coaxial cable connector array 10 of the present invention. A separate rotation mechanism 80 is formed in the same shape as first female member 20 and second female member 30. An outer surface of separate rotation mechanism 80 includes a gear configuration having gear teeth extending axially along outer surface in substantial parallel alignment with the longitudinal axis of separate rotation mechanism 80. The gear configuration on the outer surface of mechanism 80 is complementary in shape to the gear configurations of each of first and second female members 20 and 30, respectively, both discussed above. The inner surface of separate rotation mechanism 80 is configured to receive a tool (not shown), such as a hexhead power drill attachment, for rotating separate rotation mechanism 80 about its longitudinal axis.

In operation, the gear configuration on separate rotation mechanism 80 intermeshes with the gear configurations on first and second female members 20 and 30, respectively, such that rotation of separate rotation mechanism 80 causes simultaneous rotation of all the female members.

Figure 5A:
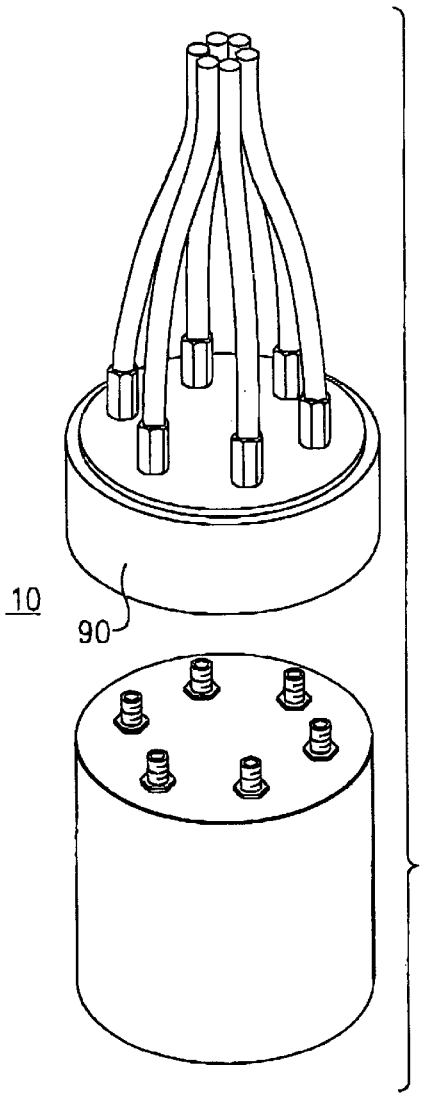
FIG. 5*a* is a perspective view of the ring member, mounting member and male ports of another embodiment of the present invention.
Figure 5B:
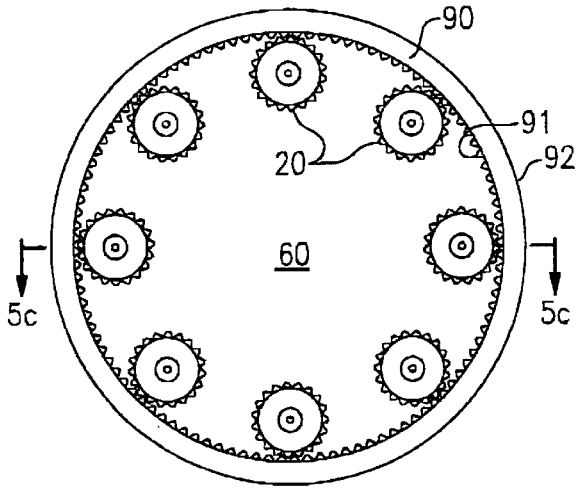
FIG. 5*b* is a bottom view showing an arrangement of the first female members from FIG. 5*a;*
Figure 5C:
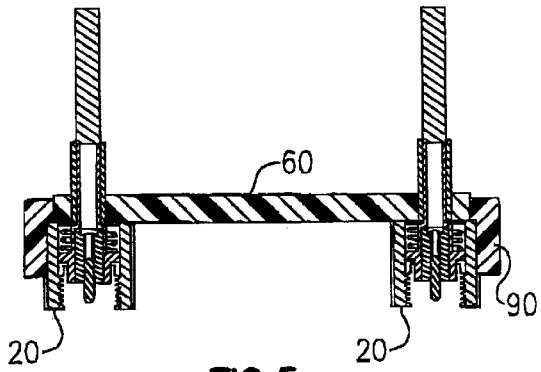
FIG. 5*c* is a cross-sectional view illustrating the first female members, the mounting member and ring member from FIG. 5*a;*
Figure 5D:
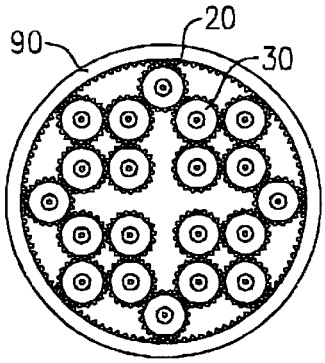
FIG. 5*d* is another bottom view showing an alternative arrangement of first and second female members.

FIGS. 5*a*–5*d* show another embodiment of the coaxial cable connector array 10 of the present invention. In FIGS. 5*a*–5*c*, a ring member 90 surrounds a plurality of the above-discussed first female members 20 arranged planetarily about an inner surface of ring member 90. The mounting member 60 discussed above is used to rotatably mount the plurality of female members. However, instead of being attached at first end 24 of each first female member 20, mounting member 60 is attached at second end 25 of first female member 20.

The ring member 90 has a generally annular shape about a longitudinal axis thereof, an inner surface 91 and an opposed outer surface 92. The inner surface 91 of ring member 90 has sufficient surface roughness to cause rotation of the plurality of first female members 20 upon rotation of ring member 90. In particular, inner surface 91 includes a gear configuration having gear teeth in intermeshing contact with the gear configurations on each first female member 20, such that rotation of ring member 90 about its longitudinal axis results in simultaneous rotation of the plurality of first female members 20 about their respective longitudinal axes.

If the female members are arranged as shown in FIG. 5*b*, then all can be first or second female members because they all rotate in the same direction. In the arrangement shown in FIG. 5*d*, however, both first 20 and second 30 female members would be arranged alternately. Rotation of ring member 90 would cause rotation of all the first female members 20, which, in turn, would cause simultaneous rotation of all second female members 30.

Figure 6A:
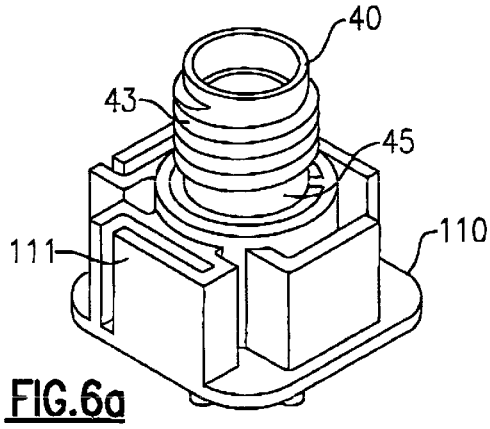
FIGS. 6*a* and 6*b* are perspective views of yet another alternative form of the positioning member that can be located on the first and second female members and/or the first and second male ports.
Figure 6B:
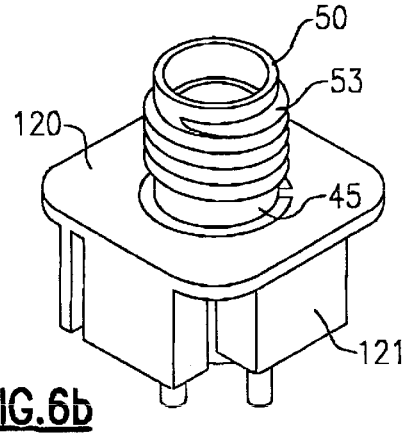
Figure 6C:
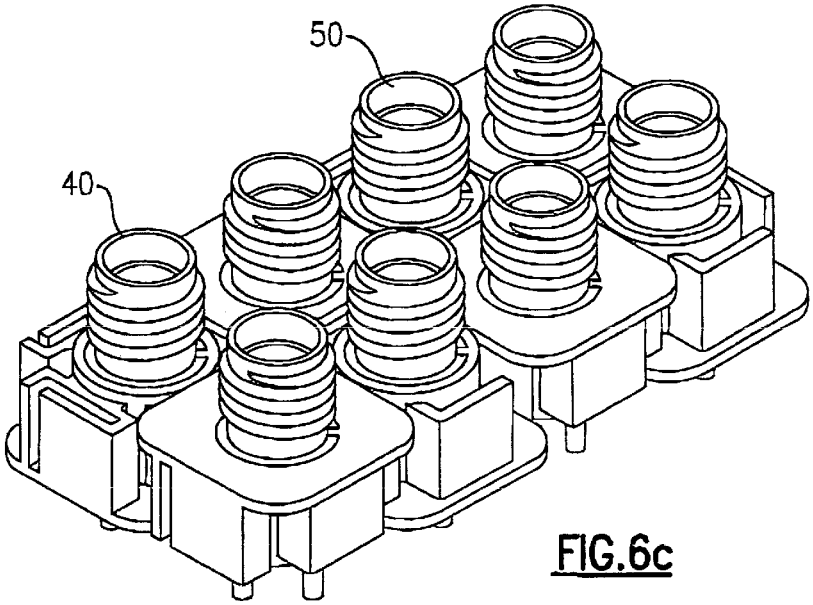
FIG. 6*c* is an assembled array of the male ports shown in FIGS. 6*a* and 6*b;*

FIGS. 6A–6C show that positioning members 110 and 120 described above can be located at second end 45 of first male port 40 and second end 55 of second male port 50. In this regard, positioning members 110 and 120 maintain a fixed spacing between the longitudinal axes of first and second male ports 40 and 50, respectively. As is the case when positioning members 110 and 120 are located at second ends 25 and 34 of first and second female members 20 and 30, respectively, when positioning members 110 and 120 are located on first male port 40 and second male port 50, they are configured to prevent any two first male ports 40, which have right-hand threads 43, from being positioned adjacent to one another and to prevent any two second male ports 50, which have left-hand threads 53, from being positioned adjacent to one another.

It can be seen in FIG. 6*c* that several first 40 and second 50 male ports can be locked together in an array using locking members 111 and 121 (which have shapes complementary to one another). Locking members 111 and 121 are designed to mate with each other and insure the alternating pattern of first 40 and second 50 male ports. The modular nature of these parts allows wide latitude in device design and set-up.

Figure 7:
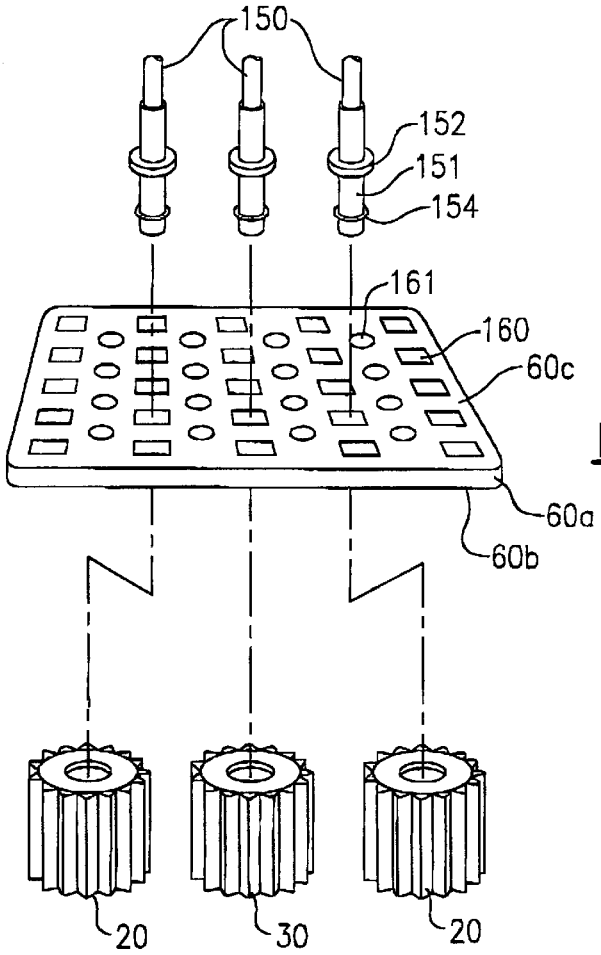
FIG. 7 is an exploded perspective view of a cable connector array in accordance with a preferred embodiment of the present invention.

FIG. 7 is an exploded perspective view of a cable connector array in accordance with a preferred embodiment of the present invention. The array includes a plurality of connector/cable subassemblies 150 passing through apertures 160 in mounting member 60*a*. Each connector/cable subassembly 150 is inserted from a second side 60*c* of mounting member 60*a* and passed through to the first side 60*b* of mounting member 60 to rotatably engage first and second female members 20 and 30, respectively, positioned facing the first side 60*b* of mounting member 60*a*. Each of the connector/cable subassemblies 150 includes a connector body 151 having a flange 152 that prevents the connector/cable subassembly from extending too far through mounting member 60*a*. A snap ring 154 is positioned within a groove 153 (FIG. 8) formed in the outer surface of connector body 151. The snap ring 154 retains the connector body 151 within the first and second female members 20 and 30, as explained below with reference to FIG. 8.

FIG. 7 shows alternating square and round apertures 160, 161 formed through mounting member 60*a*. The square apertures 160 receive the connector bodies while the round apertures 161 are used for securing the mounting member 60*a* to another structure. The square apertures 160 are designed to receive both cylindrical and square connector bodies 151. In the latter case, the square connector aperture and square connector body would prevent rotation of the connector/cable subassembly once positioned in mounting member 60*a*. There would be a slight clearance of approximately 0.05 mm between the connector body 151 and the apertures 160 so as to allow slight axial displacement of the connector body 151 within the aperture 160. Allowing the connector body 151 to float axially in this manner will compensate for axial variations between the male ports of the array to which the female array will be mated.

A similar mounting member 60 could be used to mount the male ports, provided there is a slight interference fit between the outside surface of the male port body (not shown) and the aperture 160. The male ports must be securely fastened to the mounting member to prevent rotation or axial movement of the male ports. To this end, one embodiment of the present invention includes male ports having square cross-sectional shapes and apertures formed in the mounting member having the same cross-sectional shape, but dimensioned to provide an interference fit.

Figure 8:
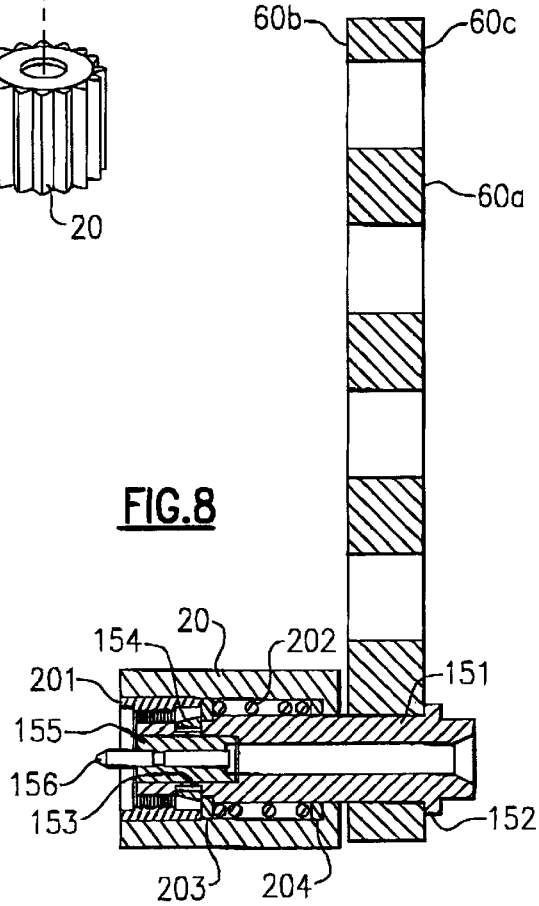
FIG. 8 is a partial cross-sectional view of the array shown in FIG. 7.

FIG. 8 is a partial cross-sectional view of the array shown in FIG. 7. The first female member 20 includes a threaded insert 201 press-fit in the first end thereof. The threads could, of course, be machined as an integral part of the first female member 20. A spring member 202 is positioned between washers 203 and 204, and all of these parts are positioned and held within the interior of female member 20 by threaded insert 201.

Once the connector body 151 is inserted through aperture 160, the female member 20 is pressed onto connector body 151 such that snap ring 154 passes through and is retained by washer 203. This engagement retains the female member 20 in rotatable position on connector body 151. The washer 204 acts as a thrust bearing so that the female member 20 can rotate independent of washer 204 and spring 202.

FIG. 8 also shows that connector body 151 includes an insulator 155 and a center contact 156. These parts are conventional.

In use, the female connector array shown in FIG. 7 would be engaged with a corresponding array of male ports arranged at center distances equal to the center distances of the female members of the female array. One of the female members would then be actuated, either manually or through the use of a power tool (discussed in more detail with respect to FIG. 9) to in turn rotate all the female members of the array. Each female member would then independently engage its corresponding male port counterpart until each is fully mated with the male port.

The spacing between washers 203 and 204 allows the female member to float in the axial direction along the connector body 151. The spring 202 biases the female connector toward the second side 60*c* of the mounting member 60. This spacing allows for "over travel" of the threaded insert 201 on the respective male port. This, in turn, prevents one female member, that may otherwise be adequately engaged with its male counterpart, from inhibiting rotation of another female member of the array that is not yet fully engaged. This "over travel" allowance and clearance between connector body 151 and mounting member 60*a* compensate for different clock positions of the threads from female member to female member, as well as slight variations in the height of the male ports. Ideally, the upper portion of each male port would lie in an identical reference plane, but these allowances insure full mating in every instance and allow for the transfer of similar coupling forces to the RF interface within each connector.

Figure 9:
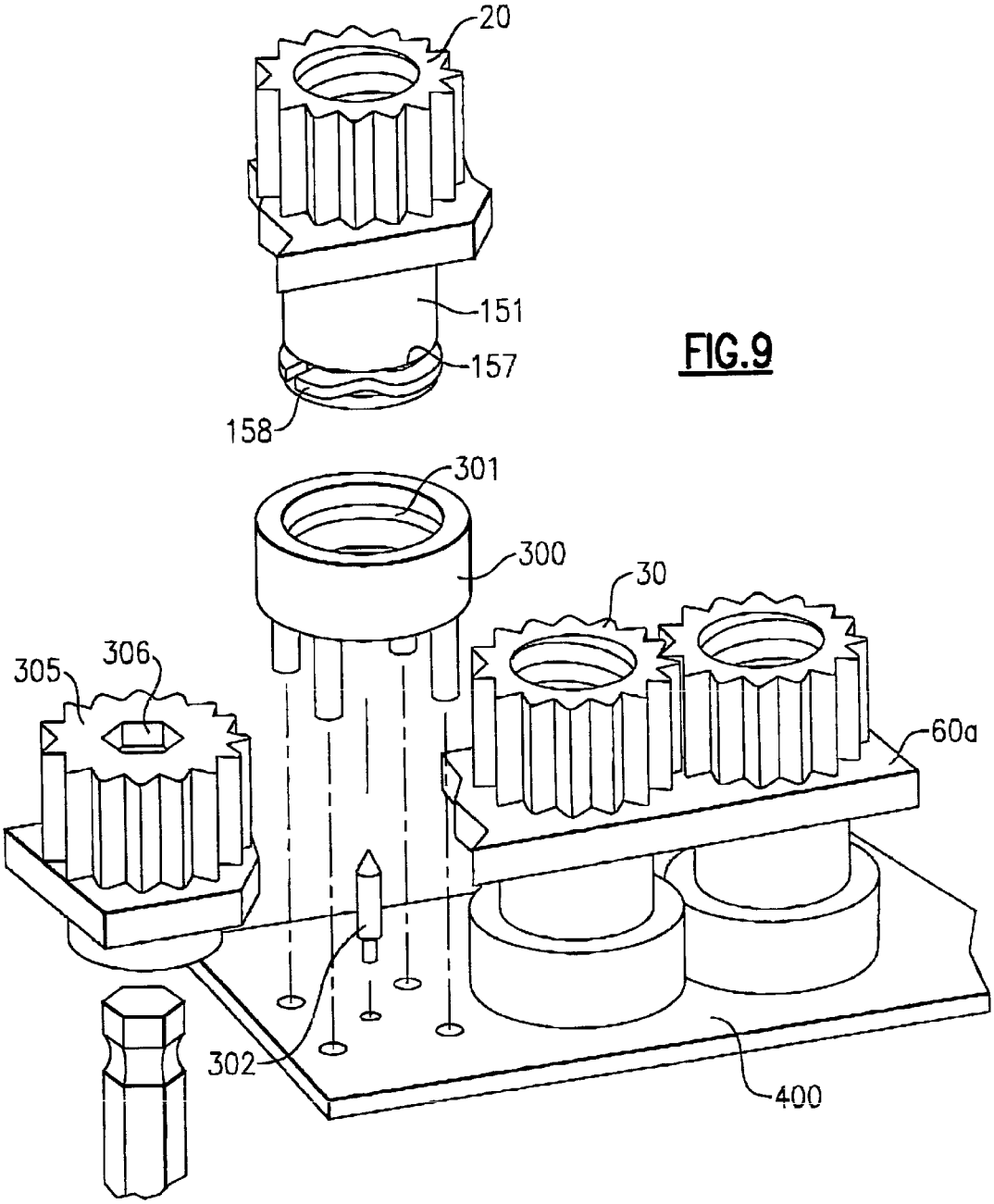
FIG. 9 is an exploded perspective view of a cable connector array in accordance with another preferred embodiment of the present invention.
Figure 10:
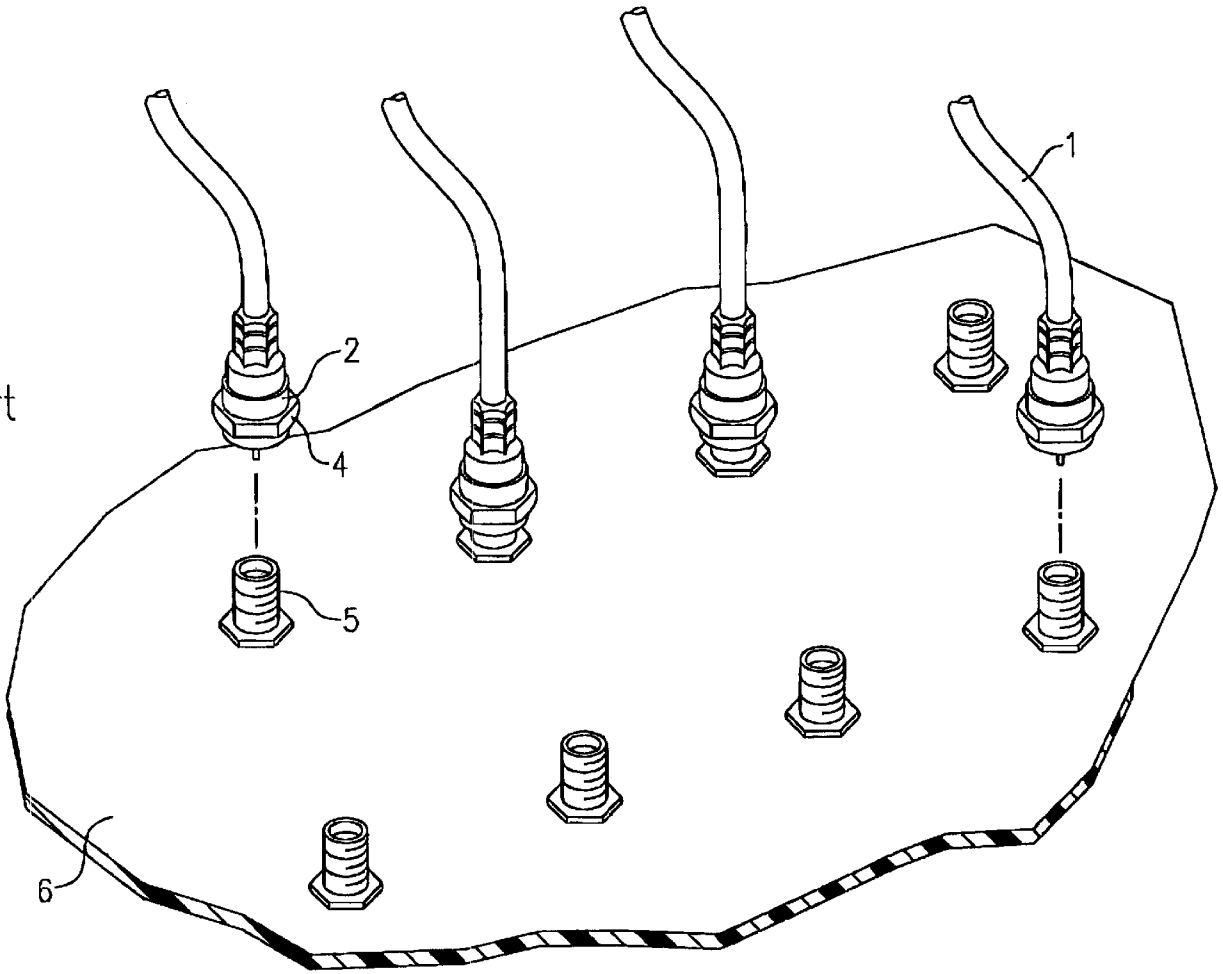
FIG. 10 Prior Art
FIG. 10 is a perspective view of a conventional coaxial cable connector array terminating the ends of coaxial cables.

FIG. 9 is an exploded perspective view of a cable connector array in accordance with another preferred embodiment of the present invention. FIG. 9 shows how the female array of the present invention would be employed when mounted to a circuit board 400.

The female members 20 and 30 pass through a mounting member 60, and are maintained in position on the mounting member 60 in the same manner as described above with respect to FIG. 8. In the embodiment shown in FIG. 9, the end of connector body 151 on which flange 152 (not shown in FIG. 9) is formed is extended and also includes a groove 157 in which a waved snap ring 158 is positioned. This portion of connector body 151 is then snapped into a metal mount 300 that has a corresponding groove 301 in its interior to accept waved snap ring 158. The perimeter of waved snap ring 158 insures good electrical contact with the metal mount 300 and the waves of the snap ring insure good electrical contact with connector body 151. A transfer pin 302 mates with center contact 156 inside connector body 151. This provides electrical conduction from center contact 156 to the circuit board 400 through transfer pain 302.

The groove 157 is axially oversized with respect to the corresponding groove 301 in metal mount 300 in order to allow axial movement of connector body 151. This movement, in addition to the movement provided by the washer/spring subassembly in the female member, compensates for variations in thread height and starting position of the male ports to which the female connector array shown in FIG. 9 will be mated.

Although not shown in FIG. 9, it is also possible to form the metal mount 300 with an external groove and snap ring, and provide an oversized, internal groove on the interior of the extended portion of connector body 151.

FIG. 9 also shows that a "dummy" female member 305 can be positioned at one end of mounting member 60, and includes a hex head receiving hole 306 on both ends thereof to allow the array to be driven by a power tool, such as a cordless screwdriver. Again, such a dummy female member could be attached to the power tool itself, and selectively inserted into the array to provide actuation of the female members.

The individual components of the invention described above may be formed by known methods (e.g., machining, molding, and the like) using any of a variety of known materials. For example, first female member 20, second female member 30, first male port 40, second male port 50 and separate rotation mechanism 80 of the coaxial cable connector array 10 can be formed from metal and injection molded plastics, more preferably from brass, beryllium copper, or stainless steel, and glass-reinforced polymers. Retaining mechanism 28*a* can be formed as a component part of the female members. Mounting member 60 can be formed from metal, plastic and the like. Positioning members 100, 110, 120 and 130 can be formed from plastic or metal, more preferably from a glass-reinforced injection molded plastic, to provide a low cost part. Ring member 90 can be formed from plastic or metal, more preferably from a glass-reinforced injection molded plastic, to provide a low cost part.

It can be appreciated from the foregoing description that the coaxial cable connector array of the present invention provides for simultaneous mating of female members with male ports, which delivers increased efficiency in both the use of time and labor during the mating process. Furthermore, since the outer surfaces of the female members can be arrayed in direct contact with one another, the present invention supplies a more compact coaxial cable connector array that does away with the need for a minimum amount of spacing between the outer circumferences of each of the female members.

While the present invention has been particularly shown and described with reference to the drawings, it will be understood by one skilled in the art that various changes in detail may be effected therein without departing from the spirit and scope of the invention as defined by the claims.

We claim:

1. An array of cable connectors comprising:

a first female member having a generally cylindrical shape about a longitudinal axis thereof, an inner surface having at least one set of left-hand threads adapted to engage complementary threads on a first male port, an opposed outer surface, a first end proximate said threads, and an opposed second end;

a second female member having a generally cylindrical shape about a longitudinal axis thereof, an inner surface having at least one set of right-hand threads adapted to engage complementary threads on a second male port, an opposed outer surface, a first end proximate said threads, and an opposed second end; and a mounting member for allowing rotation of each of said first and second female members about their respective longitudinal axes while maintaining a portion of the outer surface of said first female member in contact with a portion of the outer surface of said second female member, whereby rotation of said first female member about its longitudinal axis results in rotation of said second female member about its longitudinal axis.

2. The array of cable connectors of claim 1, wherein the outer surface of each of said first and second female members has sufficient surface roughness to cause rotation of said second female member upon rotation of said first female member.

3. The array of cable connectors of claim 1, wherein said mounting member is positioned proximate said second end of each of said first and second female members and said first and second female members are rotatably attached to said mounting member.

4. The array of cable connectors of claim 1, wherein the starting point of said left-hand threads on said first female member and the starting point of said right-hand threads on said second female member are located at the same clock position.

5. The array of cable connectors of claim 1, wherein said outer surface of said first female member has a gear configuration and said outer surface of said second female member has a complementary gear configuration such that said gear configurations intermesh to cause rotation of said second female member upon rotation of said first female member.

6. The array of cable connectors of claim 5, wherein each of said gear configurations has teeth that extend axially along the entire outer surfaces of said first and second female members, said teeth being substantially parallel to the longitudinal axes of each of said first and second female members.

7. The array of cable connectors of claim 1, wherein the outer surface of each of said first and second female members has a gear configuration, and said array further comprises a separate rotation mechanism having a gear configuration complementary to said gear configuration on each of said first and second female members, whereby said gear configuration on said separate rotation mechanism intermeshes with said gear configuration on each of said first and second female members, such that rotation of said separate rotation mechanism causes rotation of said first and second female members simultaneously.

8. The array of cable connectors of claim 7, wherein said separate rotation mechanism is removable from the array.

9. The array of cable connectors of claim 7, wherein said inner surface of said separate rotation mechanism is configured to receive a tool for rotating said separate rotation mechanism.

10. The array of cable connectors of claim 1, wherein each of said first and second female members further comprises a retaining mechanism that extends from one of said first and second ends thereof, and engages respective portions of said mounting member to hold said first and second female members on said mounting member while allowing rotation of each of said first and second female members.

11. The array of cable connectors of claim 10, wherein said retaining mechanism comprises a plurality of resilient fingers spaced apart from one another radially about said one of said first and second ends of each of said first and second female members.

12. The array of cable connectors of claim 1, wherein:

said first female member has a positioning member proximate one end thereof, and said positioning member has at least one locking member;

said second female member has a positioning member proximate one end thereof, and said positioning member has at least one locking member; and said locking member of said first female member interlocks with said locking member of said second female member.

13. The array of cable connectors of claim 12, wherein said positioning member of said first female member and said positioning member of said second female member collectively define said mounting member when interlocked with one another.

14. An array of cable connectors comprising:

a first female member having a generally cylindrical shape about a longitudinal axis thereof, an inner surface having at least one set of left-hand threads adapted to engage complementary threads on a first male port, an opposed outer surface, a first end proximate said threads, and an opposed second end;

a first connector body extending from said second end of said first female member;

a second female member having a generally cylindrical shape about a longitudinal axis thereof, an inner surface having at least one set of right-hand threads adapted to engage complementary threads on a second male port, an opposed outer surface, a first end proximate said threads, and an opposed second end; and a second connector body extending from said second end of said second female member;

a mounting member comprising a plate having a plurality of apertures formed therethrough, said first connector body being secured within a first aperture and said second connector body being secured within a second aperture, such that said first and second female members are allowed to rotate about their respective longitudinal axes while maintaining a portion of the outer surface of said first female member in contact with a portion of the outer surface of said second female member, whereby rotation of said first female member about its longitudinal axis results in a corresponding rotation of said second female member about its longitudinal axis.

15. The array of cable connectors of claim 14, wherein said first and second connector bodies each further comprise a first end positioned on a first side of said mounting member, and a second end positioned on a second side of said mounting member, said female members being rotatably secured to said first end of said connector body by a retaining mechanism.

16. The array of cable connectors of claim 15, further comprising a stop member proximate said second end of each said connector body, to limit the extent of axial movement of said connector body into said mounting member.

17. The array of cable connectors of claim 15, wherein each of said female members is axially movable with respect to said first end of said respective connector body.

18. The array of cable connectors of claim 17, wherein each of said female members is spring-biased toward said first side of said mounting member.

19. The array of cable connectors of claim 15, wherein said second end of said connector body includes a retaining mechanism for insertion into a mounting member secured to a substrate.

20. The array of cable connectors of claim 19, wherein said retaining mechanism is a waved snap ring.

21. An array of cable connector assemblies comprising:

a first female member having a generally cylindrical shape about a longitudinal axis thereof, an inner surface having at least one set of left-hand threads, an opposed outer surface, a first end proximate said threads, and an opposed second end;

a first male port having a generally cylindrical shape about a longitudinal axis thereof, an inner surface, an opposed outer surface that includes threads complementary to the threads of said first female member, a first end proximate said threads, and an opposed second end;

a second female member having a generally cylindrical shape about a longitudinal axis thereof, an inner surface having at least one set of right-hand threads, an opposed outer surface, a first end proximate said threads, and an opposed second end;

a second male port having a generally cylindrical shape about a longitudinal axis thereof, an inner surface, an opposed outer surface that includes threads complementary to the threads of said second female member, a first end proximate said threads, and an opposed second end;

means for allowing rotation of each of said first and second female members about their respective longitudinal axes while maintaining a fixed spacing between the longitudinal axes of said first and second female members; and means for maintaining a fixed spacing between the longitudinal axes of said first and second male ports substantially equal to the longitudinal axes of said first and second female members;

whereby rotation of said first female member about its longitudinal axis to engage said first male port results in rotation of said second female member about its longitudinal axis to engage said second male port.

22. The array of cable connectors of claim 21, wherein said means for allowing rotation of said first and second female members also maintains a portion of the outer surface of said first female member in contact with a portion of the outer surface of said second female member.

23. The array of cable connectors of claim 22, wherein said outer surface of said first female member has a gear configuration and said outer surface of said second female member has a complementary gear configuration such that said gear configurations intermesh and rotation of said first female member causes rotation of said second female member.

24. The array of cable connectors of claim 21, wherein said means for allowing rotation and maintaining the fixed spacing between the longitudinal axes of said first and second female members comprises a mounting member positioned proximate said first or second end of each of said first and second female members, said first and second female members being rotatably attached to said mounting member.

25. The array of cable connectors of claim 24, wherein said first and second female members further comprise first and second connector bodies, respectively, that extend from each female member and pass through apertures formed in said mounting member to hold said first and second female members on said mounting member while allowing rotation of each of said first and second female members.

26. The array of cable connector assemblies of claim 25, wherein said first and second connector bodies each further comprise a first end positioned on a first side of said mounting member, and a second end positioned on a second side of said mounting member, said female members being rotatably secured to said first end of said connector body by a retaining mechanism.

27. The array of cable connector assemblies of claim 26, further comprising a stop member proximate said second end of each said connector body, to limit the extent of axial movement of said connector body into said mounting member.

28. The array of cable connector assemblies of claim 26, wherein each of said female members is axially movable with respect to said first end of said respective connector body.

29. The array of cable connector assemblies of claim 28, wherein each of said female members is spring-biased toward said first side of said mounting member.

30. The array of cable connector assemblies of claim 26, wherein said second end of said connector body includes a retaining mechanism for insertion into a mounting member secured to a substrate.

31. The array of cable connector assemblies of claim 30, wherein said retaining mechanism is a waved snap ring.

32. The array of cable connector assemblies of claim 21, wherein the outer surface of each of said first and second female members has a gear configuration, and said array further comprises a separate rotation mechanism having a gear configuration complementary to said gear configuration on each of said first and second female members, whereby said gear configuration on said separate rotation mechanism intermeshes with said gear configuration on each of said first and second female members, such that rotation of said separate rotation mechanism causes rotation of said first and second female members simultaneously.

33. The array of cable connector assemblies of claim 32, wherein said separate rotation mechanism is removable from the array.

34. The array of cable connector assemblies of claim 32, wherein said inner surface of said separate rotation mechanism is configured to receive a tool for rotating said separate rotation mechanism.

35. An array of cable connectors comprising:

a plurality of female members each having a generally cylindrical shape about a longitudinal axis thereof, an inner surface having threads adapted to engage complementary threads on a male port, an opposed outer surface, a first end proximate said threads, and an opposed second end;

a mounting member for allowing rotation of each of said plurality of female members about their respective longitudinal axes while maintaining a fixed spacing between the longitudinal axes of each of said plurality of female members; and a ring member surrounding said plurality of female members, said ring member having a generally annular shape about a longitudinal axis thereof, an inner surface, and an opposed outer surface;

whereby rotation of said ring member about its longitudinal axis results in rotation of said plurality of female members about their longitudinal axes.

36. The array of cable connectors of claim 35, wherein the outer surface of each of said plurality of female members has a gear configuration, and said inner surface of said ring member has a gear configuration complementary to said gear configuration on each of said plurality of female members, whereby said gear configuration on said ring member intermeshes with said gear configuration on each of said plurality of female members, such that rotation of said ring member causes rotation of said plurality of female members simultaneously.

37. An array of connectors comprising:

a first female member having a generally cylindrical shape about a longitudinal axis thereof, an inner surface having at least one set of left-hand threads adapted to engage complementary threads on a first male port, an opposed outer surface, a first end proximate said threads, and an opposed second end;

a second female member having a generally cylindrical shape about a longitudinal axis thereof, an inner surface having at least one set of right-hand threads adapted to engage complementary threads on a second male port, an opposed outer surface, a first end proximate said threads, and an opposed second end; and a mounting member for allowing rotation of each of said first and second female members about their respective longitudinal axes while maintaining a portion of the outer surface of said first female member in contact with a portion of the outer surface of said second female member, whereby rotation of said first female member about its longitudinal axis results in rotation of said second female member about its longitudinal axis.

38. An array of connectors of claim 37, wherein said first and second female members terminate ends of respective gas or fluid conduits.

39. An array of connectors of claim 37, wherein said first and second female members terminate ends of fiber optic transmission lines.

40. An array of connectors of claim 37, wherein said first and second female members terminate ends of RF waveguides.

* * * * *